US007704459B2

(12) United States Patent
Merry et al.

(10) Patent No.: US 7,704,459 B2
(45) Date of Patent: Apr. 27, 2010

(54) MAT FOR MOUNTING A POLLUTION CONTROL ELEMENT IN A POLLUTION CONTROL DEVICE FOR THE TREATMENT OF EXHAUST GAS

(75) Inventors: Richard P. Merry, St. Paul, MN (US); Ulrich E. Kunze, Juechen (DE); Michael D. Swan, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1180 days.

(21) Appl. No.: 10/522,492

(22) PCT Filed: Jul. 8, 2003

(86) PCT No.: PCT/US03/21455

§ 371 (c)(1),
(2), (4) Date: Nov. 21, 2005

(87) PCT Pub. No.: WO2004/011785

PCT Pub. Date: Feb. 5, 2004

(65) Prior Publication Data

US 2006/0153746 A1 Jul. 13, 2006

(30) Foreign Application Priority Data

Jul. 31, 2002 (EP) ..... 02078103

(51) Int. Cl.
*B01D 50/00* (2006.01)

(52) U.S. Cl. ..... 422/179

(58) Field of Classification Search ..... 422/171, 422/177, 179, 180, 221; 29/890; 428/77, 428/292.1

See application file for complete search history.

(56) References Cited

U.S. PATENT DOCUMENTS

| | | | |
|---|---|---|---|
| 3,916,057 | A | 10/1975 | Hatch et al. |
| 4,011,651 | A | 3/1977 | Bradbury et al. |
| 4,181,514 | A | 1/1980 | Lefkowitz et al. |
| 4,305,992 | A | 12/1981 | Langer et al. |
| 4,929,429 | A | 5/1990 | Merry |
| 5,028,397 | A | 7/1991 | Merry |
| 5,151,253 | A | 9/1992 | Merry et al. |
| 5,250,269 | A | 10/1993 | Langer |
| 5,290,522 | A | 3/1994 | Rogers et al. |
| 5,380,580 | A | 1/1995 | Rogers et al. |
| 5,431,992 | A | 7/1995 | Houpt et al. |

(Continued)

FOREIGN PATENT DOCUMENTS

| | | | |
|---|---|---|---|
| EP | 0 273 391 | A2 | 7/1988 |

(Continued)

*Primary Examiner*—Tom Duong
(74) *Attorney, Agent, or Firm*—Harold C. Knecht, III

(57) ABSTRACT

A pollution control device suitable for use with an internal combustion engine (e.g., a diesel engine) and comprising a pollution control element arranged in a casing with non-woven mat disposed between the casing and the pollution control element, said non-woven mat being a non-intumescent mat comprising at least 90% by weight based on the total weight of the mat of chopped magnesium aluminum silicate glass fibers that have a number average diameter of 5μ or more and a length of 0.5 to 15 cm, said glass fibers being needle punched or stitch bonded and said mat being free or substantially free of organic binder.

20 Claims, 2 Drawing Sheets

U.S. PATENT DOCUMENTS

| | | | |
|---|---|---|---|
| 5,580,532 | A | 12/1996 | Robinson et al. |
| 5,736,109 | A | 4/1998 | Howorth et al. |
| 5,996,228 | A | 12/1999 | Shoji et al. |
| 6,231,818 | B1 | 5/2001 | TenEyck |

FOREIGN PATENT DOCUMENTS

| | | | |
|---|---|---|---|
| EP | 0 703 353 | A2 | 3/1996 |
| JP | 05-093445 | | 4/1993 |
| JP | 7080319 | | 3/1995 |
| JP | 2000515825 | | 11/2000 |
| JP | 2002-47070 | A | 2/2002 |
| WO | WO 94/16134 | | 7/1994 |
| WO | WO 9835144 | A1 * | 8/1998 |

* cited by examiner

MAT FOR MOUNTING A POLLUTION CONTROL ELEMENT IN A POLLUTION CONTROL DEVICE FOR THE TREATMENT OF EXHAUST GAS

CROSS REFERENCE TO RELATED APPLICATIONS

This application claims priority from PCT/US03/21455, filed Jul. 8, 2003; and from European Patent Application No. 02078103.5, filed Jul. 31, 2002.

FIELD OF THE INVENTION

The present invention relates to pollution control devices that include a mounting mat for mounting a pollution control element in the pollution control device. In particular, the invention relates to pollution control devices that are intended for the treatment of the exhaust of an internal combustion engine (e.g., a diesel engine). The mounting mat of the pollution control device can be designed so that it is particularly suited for lower temperature applications such as diesel catalytic converters or other pollution control elements adapted for reducing pollution from the exhaust of diesel engines.

BACKGROUND OF THE INVENTION

Diesel pollution control devices include catalytic converters and diesel particulate filters or traps. The pollution control devices typically comprise a metal housing or casing with a pollution control element securely mounted within the casing by a resilient and flexible mounting mat. Pollution control devices are universally employed on motor vehicles to control atmospheric pollution. Two types of devices are currently in widespread use: catalytic converters and diesel particulate filters or traps. Catalytic converters contain a catalyst, which is typically coated on a monolithic structure mounted within a metallic housing. The monolithic structures are typically ceramic, although metal monoliths have also been used. The catalyst oxidizes carbon monoxide and hydrocarbons and reduces the oxides of nitrogen in automobile exhaust gases to control atmospheric pollution.

Diesel particulate filters or traps are typically wall flow filters, which have honeycombed, monolithic structures typically made from porous crystalline ceramic materials. Alternate cells of the honeycombed structure are typically plugged such that exhaust gas enters in one cell and is forced through the porous wall to an adjacent cell where it can exit the structure. In this way, the small soot particles that are present in diesel exhaust gas are collected.

The monoliths and in particular the ceramic pollution control monoliths, used in pollution control devices are fragile and susceptible to vibration or shock damage and breakage. They have a coefficient of thermal expansion generally an order of magnitude less than the metal housing which contains them. This means that as the pollution control device is heated the gap between the inside peripheral wall of the housing and the outer wall of the monolith increases. Even though the metallic housing undergoes a smaller temperature change due to the insulating effect of the mat, the higher coefficient of thermal expansion of the metallic housing causes the housing to expand to a larger peripheral size faster than the expansion of the monolithic element. Such thermal cycling occurs hundreds of times during the life and use of the pollution control device.

To avoid damage to the ceramic monoliths from for example road shock and vibrations, to compensate for the thermal expansion difference, and to prevent exhaust gases from passing between the monolith and metal housing (thereby bypassing the catalyst), mounting mats are disposed between the ceramic monolith and the metal housing. These mats must exert sufficient pressure to hold the monolith in place over the desired temperature range but not so much pressure as to damage the ceramic monolith.

Many of the mounting mats described in the art have been developed for mounting catalytic converters for treatment of exhaust from gasoline engines which typically operate at high temperature. Known mounting mats include intumescent sheet materials comprised of ceramic fibers, intumescent materials and organic and/or inorganic binders. Intumescent sheet materials useful for mounting a catalytic converter in a housing are described in, for example, U.S. Pat. No. 3,916,057 (Hatch et al.), U.S. Pat. No. 4,305,992 (Langer et al.) U.S. Pat. No. 5,151,253 (Merry et al.) U.S. Pat. No. 5,250,269 (Langer) and U.S. Pat. No. 5,736,109 (Howorth et al.). In recent years, non-intumescent mats comprised of polycrystalline ceramic fibers and binder have been used especially for the so-called ultra thin-wall monoliths, which have significantly lower strength due to their extremely thin cell walls. Examples of non-intumescent mats are described in, for example, U.S. Pat. No. 4,011,651 (Bradbury et al.), U.S. Pat. No. 4,929,429 (Merry), U.S. Pat. No. 5,028,397 (Merry), U.S. Pat. No. 5,996,228 (Shoji et al.), and U.S. Pat. No. 5,580,532 (Robinson et al.). Polycrystalline fibers are much more expensive than normal, melt formed ceramic fibers and, therefore, mats using these fibers are only used where absolutely necessary as, for example, with ultra thin-wall monoliths.

U.S. Pat. No. 5,290,522 describes a catalytic converter having a non-woven, mounting mat comprising at least 60% by weight shot-free high strength magnesium aluminosilicate glass fibers having a diameter greater than 5 micrometers. The mounting mats taught in this reference are primarily intended for use in high temperature applications as can be seen from the test data in the examples where the mats are subjected to exhaust gas temperatures of more than 700° C.

U.S. Pat. No. 5,380,580 describes a flexible non-woven mat comprising shot-free ceramic oxide fibers selected from the group consisting of (a) aluminosilicate fibers comprising aluminum oxide in the range from 60 to about 85% by weight and silicon oxide in the range of 40 to about 15% by weight silicon oxide, based on the total weight of said aluminosilicate-based fibers, said aluminosilicate-based fibers being at least 20% by weight crystalline (b) crystalline quartz fibers and (c) mixtures of (a) and (b), and wherein the combined weight of said aluminosilicate-based fibers and said crystalline quartz fibers is at least 50% by weight of the total weight of said non-woven mat. The flexible non-woven mat can additionally comprise high strength fibers selected from the group consisting of silicon carbide fibers, silicon nitride fibers, carbon fibers, silicon nitride fibers, glass fibers, stainless steel fibers, brass fibers, fugitive fibers, and mixtures thereof.

Diesel Oxidation Catalysts (DOC's) are used on modern diesel engines to oxidize the soluble organic fraction (SOF) of the diesel particulate emitted. Because of extremely low exhaust gas temperature, mounting of DOC's with conventional mounting materials has been problematic. The exhaust gas of modern diesel engines such as turbo-charged direct injection (TDI) engines may never exceed 300° C. This temperature is below the temperature needed to expand most intumescent mats. The expansion is needed to develop and maintain appropriate pressure within the catalytic converter. Additionally, this temperature is too low to burn out the organic binder contained in intumescent mat materials. At these temperatures the binder only softens, which acts to interfere with the resiliency of the ceramic fibers. As a result, field failures have occurred with DOC's when using conventional intumescent mounting mats. To overcome these difficulties, the converters are sometimes heat treated prior to installation to expand the vermiculite and burn out the binder. This is expensive and time consuming. Auxiliary wire mesh "L" seals have also been employed to augment the holding force of intumescent mats at low temperature, but also add cost and complexity to assembly. Most non-intumescent mats while performing somewhat better still contain an organic binder, which significantly reduces the resiliency of the fibers in the 200-300° C. temperature range. This is expected to be true for other diesel exhaust pollution control devices, as well, including lean NOx catalysts, Continuous regenerating traps (CRT's) and NOx traps.

U.S. Pat. No. 6,231,818 attempts to overcome the present difficulties of mounting low-temperature, diesel catalysts by using non-intumescent mats comprised of amorphous, inorganic fibers. Although it is taught in this patent that the mat can be organic binder free, it appears that several of the mats used in the examples require the use of substantial amounts of binders. Moreover, it was found that the mounting mats disclosed in this U.S. patent, still do not adequately perform for treatment of exhaust from diesel engines, in particular TDI engines.

It was thus desirable to find an alternative mounting mat for mounting a diesel pollution control monolith in the metallic casing of a pollution control device for the treatment of exhaust from a diesel engine. In particular, it was a desire to obtain such improved mounting mats that can be manufactured in an easy and convenient way at an affordable cost. Additionally, it was a desire to find mounting mats that show good to excellent performance in at least one or more of the following tests Real Condition Fixture Test (RCFT), Cyclical Compression Test, and Hot Vibration Test. Desirably, the mounting mat is also more acceptable in terms of health, safety and environmental aspects.

SUMMARY OF THE INVENTION

In accordance with one aspect of the invention, there is provided a non-woven and non-intumescent mat comprising at least 90% by weight based on the total weight of the mat of chopped magnesium aluminium silicate glass fibers that have a number average diameter of 5 μm or more and a length of 0.5 to 15 cm, whereby the glass fibers are needle punched or stitch bonded and the mat is free or substantially free of organic binder. By 'substantially free' is meant that the amount of binder is not more than 1% by weight based on the weight of the mat, preferably not more than 0.5% by weight. The mat is used in a pollution control device for the treatment of exhaust from an internal combustion engine (e.g., a diesel engine) of a machine. The engine may be included in a stationary machine such as for example in a power generator or in a motor vehicle. The mounting mat mounts a pollution control element (e.g., a diesel pollution control monolith) in a housing (e.g., a metallic casing) of the pollution control device and is typically arranged between the casing and the pollution control element.

According to a particular aspect, there is provided a mat for mounting a pollution control element (e.g., a diesel pollution control monolith) in a housing (e.g., a metallic casing) of a pollution control device, the mat being a non-intumescent mat comprising at least 90% by weight based on the total weight of the mat of chopped magnesium aluminium silicate glass fibers that have a number average diameter of 5 μm or more and a length of 0.5 to 15 cm, the glass fibers being needle punched or stitch bonded, the mat being free or substantially free of organic binder and being comprised of at least two layers of the chopped magnesium aluminium silicate glass fibers, wherein the two layers are differing in their glass fiber composition. A mat according to this aspect was found to be particularly suitable for optimizing performance and manufacturing cost of a mounting mat for pollution control devices for diesel engine exhaust.

In another aspect of the invention, there is provided a method of treating exhaust gas from an internal combustion engine (e.g., a diesel engine) by subjecting the exhaust gas to a pollution control device comprising a pollution control element (e.g., a diesel pollution control monolith) arranged in a housing (e.g., metallic casing) with a non-woven mat disposed between the casing and the pollution control element, said non-woven mat being a non-intumescent mat comprising at least 90% by weight based on the total weight of the mat of chopped magnesium aluminium silicate glass fibers that have a number average diameter of 5 μm or more and a length of 0.5 to 15 cm, said glass fibers being needle punched or stitch bonded and said mat being free or substantially free of organic binder.

With term 'diesel pollution control monolith' is meant a monolithic structure that is suitable for and/or adapted for reducing the pollution caused by exhaust from a diesel engine and in particular includes monolithic structures that are operative in reducing the pollution at low temperatures, e.g. of 350° C. or less. Diesel pollution control monoliths include without limitation catalytic converters, diesel particulate traps and NOx absorbers or traps.

The term 'magnesium aluminium silicate glass fibers' includes glass fibers that comprise oxides of silicon, aluminium and magnesium without excluding the presence of other oxides, in particular other metal oxides.

BRIEF DESCRIPTION OF THE DRAWINGS

Solely for the purpose of illustration and better understanding of the invention and without the intention to limit the invention in any way thereto, the following drawings are provided.

DETAILED DESCRIPTION OF THE PRESENT INVENTION

Figure 1:
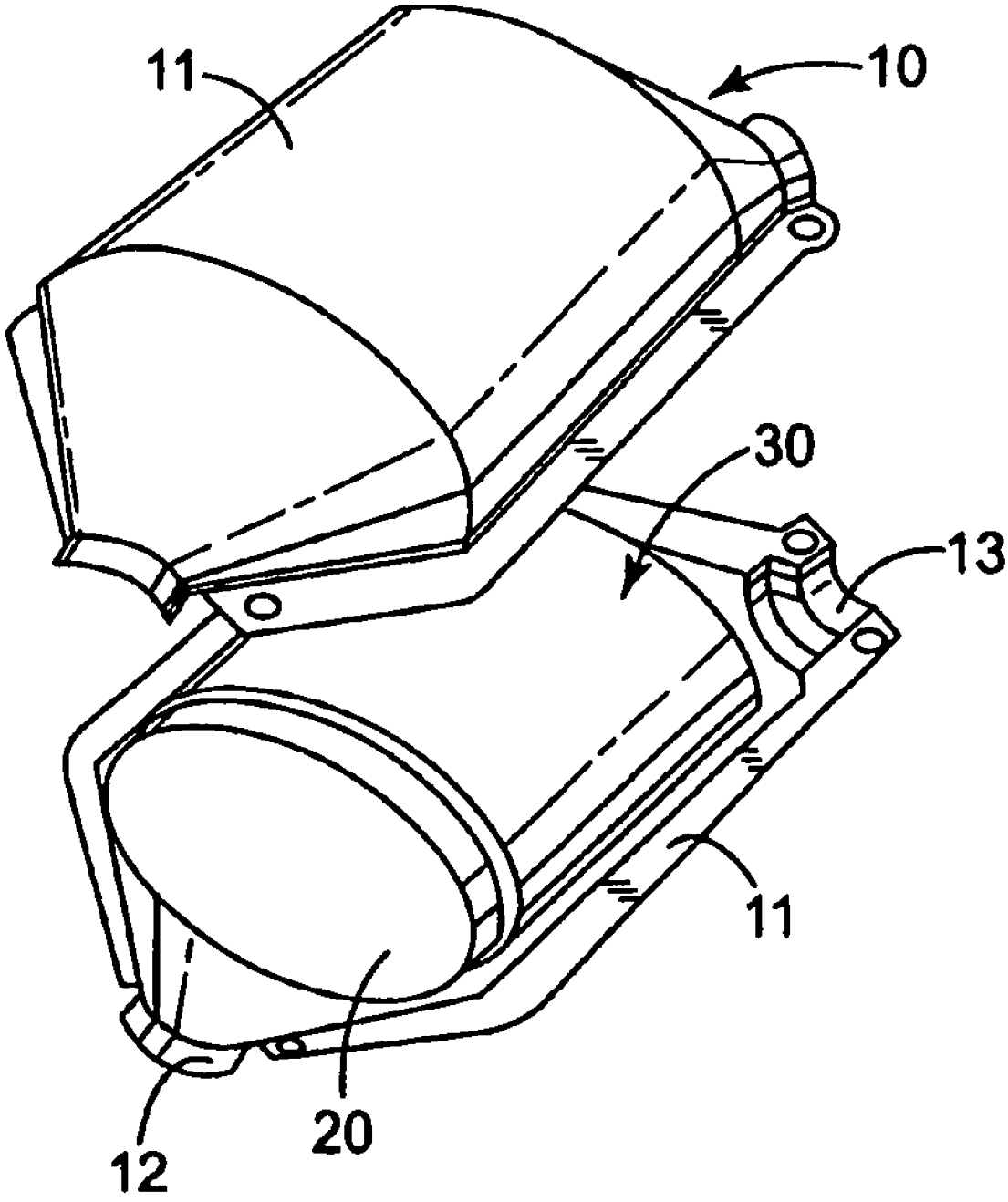
FIG. 1 is a perspective view of a catalytic converter of the present invention shown in disassembled relation.

Referring to FIG. 1 pollution control device 10 comprises metallic casing or housing 11 with generally frusto-conical inlet and outlet ends 12 and 13, respectively. Disposed within casing 11 is a diesel pollution control monolith 20 e.g., formed of a honeycombed monolithic body having a plurality of gas flow channels (not shown) there through. Surrounding diesel pollution control monolith 20 is mounting mat 30 comprising the chopped magnesium aluminosilicate glass fibers which serves to tightly but resiliently support monolithic element 20 within the casing 11. Mounting mat 30 holds diesel pollution control monolith 20 in place in the casing and seals the gap between the diesel pollution control monolith 20 and casing 11 to thus prevent or minimize diesel exhaust gases from by-passing diesel pollution control monolith 20.

The metallic casing can be made from materials known in the art for such use including stainless steel.

Examples of diesel pollution control monoliths for use in the pollution control device 10 include catalytic converters and diesel particulate filters or traps. Catalytic converters contain a catalyst, which is typically coated on a monolithic structure mounted within a metallic housing. The catalyst is typically adapted to be operative and effective and low temperature, typically not more than 350° C. The monolithic structures are typically ceramic, although metal monoliths have also been used. The catalyst oxidizes carbon monoxide and hydrocarbons and reduces the oxides of nitrogen in exhaust gases to control atmospheric pollution. While in a gasoline engine all three of these pollutants can be reacted simulataneously in a so-called "three way converter", most diesel engines are equipped with only a diesel oxidation catalytic converter. Catalytic converters for reducing the oxides of nitrogen, which are only in limited use today for diesel engines, generally consist of a separate catalytic converter. Suitable ceramic monoliths used as catalyst supports are commercially available from Corning Inc. (Corning N.Y.) under the trade name of "CELCOR" and commercially available from NGK Insulated Ltd (Nagoya, Japan) under the trade name of "HONEYCERAM", respectively.

Diesel particulate filters or traps are typically wall flow filters, which have honeycombed, monolithic structures typically made from porous crystalline ceramic materials. Alternate cells of the honeycombed structure are typically plugged such that exhaust gas enters in one cell and is forced through the porous wall to an adjacent cell where it can exit the structure. In this way, the small soot particles that are present in diesel exhaust gas are collected. Suitable diesel particulate filters made of cordierite are commercially available from Corning Inc. (Corning N.Y.) and NGK Insulated Inc. (Nagoya, Japan). Diesel particulate filters made of Silicon Carbide are commercially available from Ibiden Co. Ltd. (Japan) and are described in, for example, JP 2002047070A.

The magnesium aluminium silicate glass fibers used in the non-woven mounting mat have an average diameter of at least 5 μm and a length between 0.5 and 15 cm, preferably between 1 and 12 cm. Preferably, the average diameter will be at least 7 μm and is typically in the range of 7 to 14 μm. The glass fibers are preferably individualized. To provide individualized (i.e., separate each fiber from each other) fibers, a tow or yarn of fibers can be chopped, for example, using a glass roving cutter (commercially available, for example, under the trade designation "MODEL 90 GLASS ROVING CUTTER" from Finn & Fram, Inc., of Pacoma, Calif.), to the desired length (typically in the range from about 0.5 to about 15 cm). The fibers typically are shot free or contain a very low amount of shot, typically less than 1% by weight based on total weight of fibers. Additionally, the fibers are typically reasonably uniform in diameter, i.e. the amount of fibers having a diameter within +/−3 μm of the average is generally at least 70% by weight, preferably at least 80% by weight and most preferably at least 90% by weight of the total weight of the magnesium aluminium silicate glass fibers.

The mat may contain up to 10% by weight of fibers other than magnesium aluminium silicate glass fibers. Preferably however, the mat will consist of only magnesium aluminium silicate glass fibers. If other fibers are contained in the mat, they will typically be amorphous fibers and they should preferably also have an average diameter of at least 5 μm. Preferably, the mat will be free or essentially free of fibers that have a diameter of 3 μm or less, more preferably the mat will be free or essentially free of fibers that have a diameter of less than 5 μm. Essentially free here means that the amount of such small diameter fibers is not more than 2% by weight, preferably not more than 1% by weight of the total weight of fibers in the mat.

In a preferred method for making the nonwoven mat, the cut or chopped fibers can be separated by passing them through a conventional two zone Laroche Opener (e.g., commercially available from Laroche S.A., Cours la Ville, France). The fibers can also be separated by passing them through a hammer mill, preferably a blow discharge hammer mill (e.g., commercially available under the trade designation "BLOWER DISCHARGE MODEL 20 HAMMER MILL." from C.S. Bell Co. of Tiffin, Ohio). Although less efficient, the fibers can be individualized using a conventional blower such as that commercially available under the trade designation "DAYTON RADIAL BLOWER," Model 3C 539, 31.1 cm (12.25 inches), 3 horsepower from W. W. Grainger of Chicago, Ill. The chopped fibers normally need only be passed through the Laroche Opener once. When using the hammer mill, they generally must be passed though twice. If a blower is used alone, the fibers are typically passed through it at least twice. Preferably, at least 50 percent by weight of the fibers are individualized before they are formed into a nonwoven mat.

Although cut or chopped fibers greater than about 15 cm are also useful in preparing the nonwoven mat, they tend to be more difficult to process. Separation of the fibers tends to increase the loftiness (i.e., decrease the bulk density) of the fibers making up the nonwoven mat thereby lowering the density of the resulting mat.

To facilitate processing and separation of the chopped or cut fibers with minimal breakage an antistatic lubricant (e.g., such as that commercially available under the trade designation "NEUTROSTAT" from Simco Co. Inc., of Hatfield, N.J.) can be sprayed into the hammer mill while the fibers are being separated.

The magnesium aluminium silicate glass fibers preferably comprise between 10 and 30% by weight of aluminium oxide, between 52 and 70% by weight of silicium oxide and between 1 and 12% of magnesium oxide. The weight percentage of the aforementioned oxides are based on the theoretical amount of $Al_2O_3$, $SiO_2$ and MgO. It will further be understood that the magnesium aluminium silicate glass fiber may contain additional oxides. For example, additional oxides that may be present include sodium or potassium oxides, boron oxide and calcium oxide. Particular examples of magnesium aluminium silicate glass fibers include E-glass fibers which typically have a composition of about 55% of $SiO_2$, 11% of $Al_2O_3$, 6% of $B_2O_3$, 18% of CaO, 5% of MgO and 5% of other oxides; S and S-2 glass fibers which typically have a composition of about 65% of $SiO_2$, 25% of $Al_2O_3$ and 10% of MgO and R-glass fibers which typically have a composition of 60% of $SiO_2$, 25% of $Al_2O_3$, 9% of CaO and 6% of MgO. E-glass, S-glass and S-2 glass are available for example from Advanced Glassfiber Yarns LLC and R-glass is available from Saint-Gobain Vetrotex.

According to a method for making the nonwoven mat, chopped, individualized fibers (preferably, about 2.5 to about 5 cm in length) are fed into a conventional web-forming machine (commercially available, for example, under the trade designation "RANDO WEBBER" from Rando Machine Corp. of Macedon, N.Y.; or "DAN WEB" from ScanWeb Co. of Denmark), wherein the fibers are drawn onto a wire screen or mesh belt (e.g., a metal or nylon belt). If a "DAN WEB"-type web-forming machine is used, the fibers are preferably individualized using a hammer mill and then a blower. Fibers having a length greater than about 2.5 cm tend to become entangled during the web formation process. To facilitate ease of handling of the mat, the mat can be formed on or placed on a scrim. Depending upon the length of the fibers, the resulting mat typically has sufficient handleability to be transferred to a needle punch machine without the need for a support (e.g., a scrim).

The nonwoven mat can also be made using conventional wet-forming or textile carding. For wet forming processes, the fiber length is preferably about 0.5 to about 6 cm. For textile processes, the fiber length is preferably about 5 to about 10 cm.

A needle-punched nonwoven mat refers to a mat wherein there is physical entanglement of fibers provided by multiple full or partial (preferably, full) penetration of the mat, for example, by barbed needles. The nonwoven mat can be needle punched using a conventional needle punching apparatus (e.g., a needle puncher commercially available under the trade designation "DILO" from Dilo of Germany, with barbed needles (commercially available, for example, from Foster Needle Company, Inc., of Manitowoc, Wis.)) to provide a needle-punched, nonwoven mat. Needle punching, which provides entanglement of the fibers, typically involves compressing the mat and then punching and drawing barbed needles through the mat. The optimum number of needle punches per area of mat will vary depending on the particular application. Typically, the nonwoven mat is needle punched to provide about 5 to about 60 needle punches/$cm^2$. Preferably, the mat is needle punched to provide about 10 to about 20 needle punches/$cm^2$.

Preferably, the needle-punched, nonwoven mat has a weight per unit area value in the range from about 1000 to about 3000 g/$m^2$, and in another aspect a thickness in the range from about 0.5 to about 3 centimeters. Typical bulk density under a 5 kPA load is in the range 0.1-0.2 g/cc.

The nonwoven mat can be stitchbonded using conventional techniques (see e.g., U.S. Pat. No. 4,181,514 (Lefkowitz et al.), the disclosure of which is incorporated herein by reference for its teaching of stitchbonding nonwoven mats). Typically, the mat is stitchbonded with organic thread. A thin layer of an organic or inorganic sheet material can be placed on either or both sides of the mat during stitchbonding to prevent or minimize the threads from cutting through the mat. Where it is desired that the stitching thread not decompose in use, an inorganic thread, such as ceramic or metal (e.g., stainless steel) can be used. The spacing of the stitches is usually from 3 to 30 mm so that the fibers are uniformly compressed throughout the entire area of the mat.

In accordance with a particular embodiment of the present invention, the mat may be comprised of a plurality of layers of the magnesium aluminium silicate glass fibers. Such layers may be distinguished from each other in the average diameter of the fibers used, the length of the fibers used and/or the chemical composition of the fibers used. Since the heat resistance and mechanical strength of fibers at temperature vary with their composition and to a lesser degree fiber diameter, fiber layers can be selected to optimize performance while minimizing cost. For example, a nonwoven mat consisting of a layer of S-2 glass combined with a layer of E-glass can be used to mount a diesel catalytic converter. In use the S-2 glass layer is placed directly against the hotter, monolith side of the catalytic converter while the E-glass layer is against the cooler, metal housing side of the catalytic converter. The layered combination mat can withstand considerably higher temperatures than a mat consisting of only E-glass fibers at greatly reduced cost compared to a mat consisting of only S-2 glass fibers. The layered mats are made by first forming the individual non-woven layers having a specific type of fiber using the forming techniques described earlier. These layers are then needle bonded together to form the finished mat having the desired discrete layers.

The mounting mats of the invention are particularly suitable for mounting a diesel pollution control monolith in a pollution control device. Typically, the mount density of the mat, i.e., the bulk density of the mat after assembly, should be at least 0.2 g/$cm^3$ to provide sufficient pressure to hold the monolith securely in place. At mount densities above about 0.70 g/$cm^3$ the fibers can be unduly crushed. Also at very high mount density there may be a risk that the monolith breaks during assembly of the pollution control device. Preferably, the mount density should be between about 0.25 g/$cm^3$ and 0.45 g/$cm^3$. The pollution control device has excellent performance characteristics for use in low temperature applications such as in the treatment of diesel engine exhaust. The pollution control device may be used in a stationary machine to treat the exhaust emerging from a diesel engine contained therein. Such stationary machines include for example power sources for generating electricity or pumping fluids.

The pollution control device is in particular suitable for the treatment of exhaust from diesel engines in motor vehicles. Examples of such motor vehicles include trains, buses, trucks and 'low capacity' passenger vehicles. By 'low capacity' passenger vehicles is meant a motor vehicle that is designed to transport a small number of passengers, typically not more than 15 persons. Examples thereof include cars, vans and so-called mono-volume cars. The pollution control device is particularly suitable for the treatment of exhaust from turbo charged direct injection diesel engines (TDI) which are more and more frequently used in motor vehicles in particular in Europe.

The following examples further illustrate the invention without however intending to limit the scope of the invention thereto.

EXAMPLES

Materials Employed in the Examples

S-2 Glass fibers, diameter about 9 μm, chopped to a length of 1.0 inches (25.4 mm), obtainable as 401 S-2 Glass Chopped Strands from Advanced Glassfiber Yarns LLC (AGY), Aiken, S.C./USA.

E Chopped glass strands, diameter 9 μm, chopped to a length of 1 inch (25.4 mm) from Advanced Glassfiber Yarns LLC (AGY), Aiken, S.C./USA.

R Glass fibers (typical composition 60% $SiO_2$, 25% $Al_2O_3$, 9% CaO, and 6% MgO) having a diameter of ca. 10 μm, chopped to a length of 36 mm, available from Saint-Gobain Vetrotex Deutschland GmbH, Herzogenrath/Germany.

Test Methods

Real Condition Fixture Test (RCFT)

This test models actual conditions found in a pollution control device with a monolith or diesel particulate trap during typical use, and measures the pressure exerted by the mounting material under those modelled use conditions. The RCFT method is described in detail in *Material Aspects in Automotive Pollution control devices*, ed. Hans Bode, Wiley-VCH, 2002, pp. 206-208.

Two 50.8 mm by 50.8 mm heated stainless steel platens, controlled independently, were heated to different temperatures to simulate the metal housing and monolith temperatures, respectively. Simultaneously, the space or gap between platens was increased by a value calculated from the temperature and the thermal expansion coefficients of a typical pollution control device of the type specified. Normal driving conditions for the diesel pollution control device are simulated by a monolith temperature of up to 300° C. and a metal housing temperature of up to 100 and more severe conditions as may occur during continuous driving at high speed as for example on a motorway were simulated with a monolith temperature of up to 500° C. and a metal housing temperature of up to 200° C.

Three cycles of the RCFT were performed on each mounting mat sample using a 1200-1400 g/m$^2$ weight per area mat. The density of the mat when mounted in the test sample was 0.35 g/cm$^3$. The intumescent comparative example was tested at a density of 1.0 g/cc.

After the three RCFT cycles are run, data curves are generated. The curves show the pressure between the two plates as a function of temperature, where the temperatures of the first and second plates, respectively were first increased, held at temperature for 15 minutes and then reduced.

Hot Vibration Test

The hot vibration test was used to further evaluate the suitability of the mounting mat according to the present invention as a mounting mat for a low temperature, pollution control device for diesel engines. The hot vibration test involved passing exhaust gas through a pollution control device element mounted with a mounting mat in a metallic casing (referred to as a test assembly below) while simultaneously subjecting the converter assembly to mechanical vibration sufficient to serve as an accelerated durability test.

The test assembly comprised:

1) a cylindrical ceramic monolith (4.66 inches (11.8 cm) in diameter by 3.0 inches (7.6 cm) in length) having 350 cells/in$^2$ and wall thickness of 5.5 mil (0.14 mm), 2) a mounting mat described in the Examples or Comparative Examples below arranged in a cylindrical manner between the monolith and the metal housing and 3) a cylindrical can-shaped housing comprising 409 stainless-steel having an inside diameter of approximately 4.88 inches (12.4 cm).

A conventional shaker table (commercially available from Unholtz-Dickie Corp. of Wallingford, Conn./USA) was employed to provide vibration to the test assembly. The heat source comprised a natural gas burner capable of supplying gas inlet temperature to the converter of up to 1000° C. The converter was equipped with a thermocouple to measure the interface temperature between the outside surface of the monolith and the inside surface of mounting mat. The exhaust gas temperature was cycled (raised and lowered repeatedly) so as to put extra stress on the mounting mat material. A 15-hour thermal conditioning stage was carried out before the shaking segment of the test was started. The thermal conditioning stage consisted of 5 cycles of two hours at a selected elevated temperature followed by 1 hour at 50° C. During the shaking segment of the test, "sine on random" type vibration was employed to generate further stress and simulate accelerated ageing of the test assembly under use conditions. In a first step, the vibration began at a vibration level of 1.75 g (in this vibration test, 'g' represents the force of gravity) on a random 0.01 g$^2$/Hz (approximately 10 g peak). The vibration was continued for 3 hours at the selected elevated temperature and then stopped. The test assembly was allowed to cool to 50° C. and held there for 1 hour without shaking. In a second step, the vibration level was then doubled (i.e. 3.5 g sine on 0.02 g$^2$/hz random) as the test assembly was heated for an additional 3 hours at temperature. The vibration was then stopped for a second hour and cooling to and holding at 50° C. In a third step, the vibration parameters just described were doubled and the cycle (comprising 3 hrs shaking at the selected elevated temperature and 1 hour at 50° C.) was repeated. In a fourth step, the vibration parameters were again doubled, for a total 4 steps, i.e., until vibration parameters comprising a sine of 28 g's on 0.16 g$^2$/hz random (approximately 61 g peak) were attained. The test assembly was subjected further to the last set of vibration parameters until test assembly failure was noted or until at least 14 cycles at 28 g's sine on 0.16 g$^2$/hz random was reached.

Cyclical Compression Test

The test apparatus for the Cyclical Compression Test comprised:

a) a commercially available test instrument (commonly known as a tensile tester) comprising a lower fixed portion and an upper portion movable apart from the lower portion in the vertical direction at a rate defined as the "crosshead speed" and bearing a load cell capable of measuring forces up to 30 kN (MTS™ Model Alliance RT/30, available from Material Test Systems, Cary, N.C.), b) a first quartz tube (50.8 mm in diameter×20 cm long) attached in a vertical manner to the fixed lower portion of the instrument, c) a second quartz tube (50.8 mm in diameter×20 cm long) attached in a vertical manner to the load cell on the upper portion of the instrument, d) a thermocouple extended through the upper quartz tube to make contact with the test assembly and e) an electrically heated oven having a brick lining bearing a tubular hole arranged such that it intimately surrounded the portions of the two quartz tubes nearest one another.

The test assembly consisted of three discs superimposed upon one another:

a) a larger lower quartz disc (20.0 mm in thickness, 75 mm in diameter) for supporting the test sample b) a test sample of a mounting mat to be tested comprising a weighed disc of the mounting mat to be tested having a diameter of a ca. 2 inches (51 mm)

c) a smaller upper quartz disc (12.5 mm in thickness, 51 mm in diameter) located on top of the test sample.

The test assembly was placed between the upper end of the lower quartz tube and the lower end of the upper quartz tube in a manner such that the three discs of the test assembly were arranged vertically with relation to each other.

Two gap distances were then selected:

1) Gap 1—a first smaller distance between the two quartz discs

2) Gap 2—a second larger distance between the two quartz discs.

The gap distances were selected so that the mounting mat sample to be tested had a density corresponding to the recommended mount density for a given material at the smaller "gap 1" and at the "larger gap 2" a density of 10% above the density at smaller "gap 1", these parameters being selected based on mat densities commonly encountered when mounting mats are employed under actual use conditions.

The two gap distances thus selected were then programmed into the instrument, the oven was closed around the test assembly and heated to and held at 250° C., and finally the instrument was programmed to repeatedly move from one gap distance to the other, thus repeatedly increasing and decreasing pressure on the sample disc located in the test assembly between the two quartz discs. The cross-head speed was 5.0 mm/min and there was essentially no dwell time at either of the "gap 1" or "gap 2" positions.

The pressure exerted by the sample disc at any one time was recorded in units of kilo Pascal (kPa). The compression cycle was repeated 1000 times.

The pressure exerted by the sample disc at the beginning of the test in the (initial pressure) was recorded while the instrument was in the smaller "gap 1" location of the compression cycle. The pressure exerted by the sample disc after 1000 compression cycles at 250° C. (final pressure) was also recorded, again while the instrument was in the smaller "gap 1" location of the compression cycle.

These two numbers were compared in the following manner: (final pressure/initial pressure)×100%=percent retention.

Example 1

40 liters of S-2 glass fibers of approximately 9 μm in average diameter and 2.54 cm in length were obtained from Advanced Glassfiber Yarns LLC (AGY). The fibers were essentially shot free.

The glass fibers were opened in a two-zone Laroche opener. The first zone had a feed speed of 2 m/min and a Lickerin roll speed of 2,500 rev/min. The second zone had a feed speed of 4 m/min and a Lickerin roll speed of 2,500 rev/min. The output speed was 6.5 m/min.

The opened fibers were then fed into a conventional web-forming machine (commercially available under the trade designation "Rando Webber" from Rando Machine Corp. of Macedon, N.Y., wherein the fibers were blown onto a porous metal roll to form a continuous web. The continuous web was then needle-bonded on a conventional needle tacker. The needle speed was 100 cycles/min and the output speed was 1.1 m/min. The "weight per area" of the mounting mat could be adjusted as desired. In tests where the value of "weight per area" substantially influences the test results, this parameter is indicated along with the test results. The composition of the mounting mat of Example 1 is summarized in Table 1 below.

Figure 2:
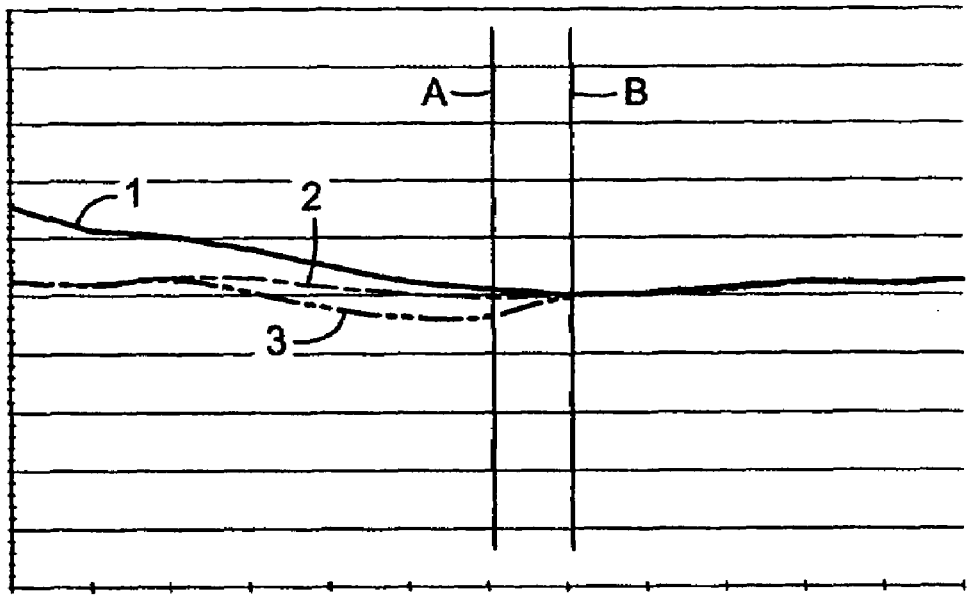
FIGS. 2 and 3 show the results of the mats of Example 1 and Comparative Examples 1 and 2 in a Real Condition Fixture Test.

The mat of Example 1 was tested according to the RCFT method described above under Test Methods. A family of three data curves was generated, representing each of three cycles. The mounting mats of Example 1 displayed a very uniform pressure over the temperature range examined and provided a pressure well above the minimum pressure (about 40 kPa) needed to hold the monolith securely in place. The RCFT data for Example 1 are shown in FIG. 2. In FIG. 2, the X-axis represents the temperature scale for the simulated monolith temperature and the simulated skin temperature. For the monolith temperature, the temperature range represented in FIG. 1 was from 20 to 300° C. at the line indicated with 'A' and from 300 (indicated by the line 'B') back to 50° C. For the simulated skin temperature, the ranges were respectively 20 to 100° C. and 100° C. to 25° C. The interval between lines A and B indicates a period of 15 minutes for which the sample was held at the maximum temperature. The Y-axis represents the pressure measured. The scale was from 0 to 500 kPa. Curve 1 to 3 represent the results of the $1^{st}$ to $3^{rd}$ cycle respectively. An adequate holding force over the entire temperature range tested was found as can be seen in FIG. 2.

The mat of Example 1 was also subjected to the Hot Vibration Test as described above under Test Methods. The Hot Vibration Test was performed at two temperatures: 300° C. and 500° C., respectively. At 300° C., the mat of Example 1 had not failed after 72 hours. At 500° C., Example 1 had not failed after 80 hours. Hot Vibration Test results are summarized below in Table 2.

Example 2

Example 2 was prepared by the method described in Example 1 with the exception that E-glass fibers (chopped glass strands, diameter 9 μm, chopped to a length of 1 inch (25.4 mm) available from Advanced Glassfiber Yarns LLC (AGY), Aiken, S.C., USA) were employed. The composition of the mat of Example 2 is summarized in Table 1.

Tests on the mat of Example 2 include the Cyclical Compression Test. Results are summarized in Table 3 and show that at diesel pollution control device temperatures (i.e., average mat temperature of 250° C.), the mat keeps 86.3% of its original pressure after 1000 compression cycles.

Example 2 was also tested in the RCFT using the same conditions as used in Example 1. Example 2 maintained adequate holding force over the entire temperature range.

Example 3

R-glass fibers (60% $SiO_2$, 25% $Al_2O_3$, 9% CaO, and 6% MgO) having a diameter of ca. 10 μm, chopped to a length of 36 mm, obtained from Saint-Gobain Vetrotex, were processed into a web by the method described in Example 1. The composition of the mat of Example 4 is summarized in Table 1.

Tests on the R-glass mat of Example 3 include the Cyclical Compression Test. Results are summarized in Table 3 below and show that at diesel pollution control device temperatures (i.e., average mat temperature of 250° C.), the mat keeps 95.5% of its original pressure after 1000 compression cycles.

Additionally, an RCFT test was performed on the mat of Example 3 in the same way as for the mat of Example 1 except that the simulated temperature range for the monolith was from 25° C. to 500° C. and 25 to 200° C. for the skin. Example 3 maintained adequate holding force over the entire temperature range.

Example 4

A two layer mat was prepared by laminating two separately prepared layers together. The first layer comprised R-glass. The second layer comprised E-glass. The two layers were put together by needle-bonding. The mounting mat formed in this manner had two discrete layers of glass of differing compositions. The composition of the two layer mat of Example 4 is summarized in Table 1.

The two layer mat of Example 4 was subjected to the RCFT Test using the temperature conditions of Example 3. The mounting mat of Example 4 maintained adequate holding force over the entire temperature range.

Example 5

A two layer mat was prepared by laminating two separately prepared layers together. The first layer comprised S-2 glass. The second layer comprised E-glass. The two layers were put together by needle bonding. The mounting mat formed in this manner had two discrete layers of glass of differing compositions. The composition of the mat of Example 5 is summarized in Table 1.

The mat of Example 5 was subjected to the Cyclical Compression Test. Results are summarized in Table 3 and show that at diesel converter temperatures (i.e., average mat temperature of 250° C.), the mat keeps 82.2% of its original pressure after 1000 compression cycles.

Comparative Example 1

Comparative Example 1 (C1) comprised a binder-free, non-woven fiber mat made of Belcotex silica fibers having a fiber diameter of 9 microns, obtained from Belchem Fiber Materials GmbH, Brand-Erbisdorf, Germany.

Figure 3:
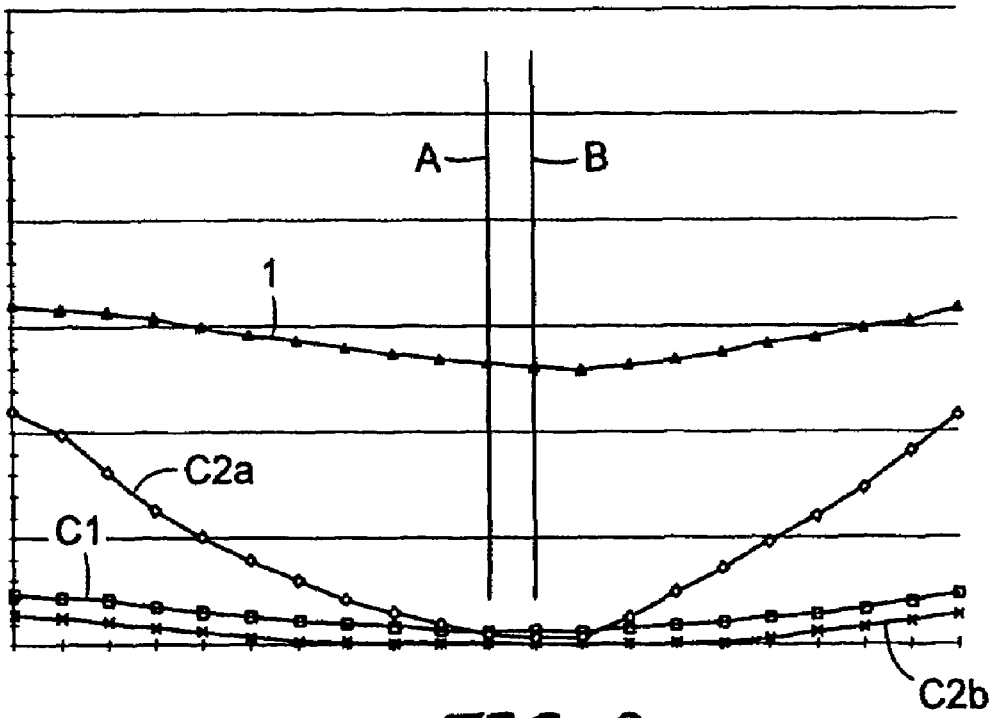

This material was subjected to the Real Conditions Fixture Test (RCFT) at a mount density of 0.4 g/cm$^3$. The temperature ranges used, were the same as used in Example 3 above. Test results are shown in FIG. 3 by the curve C1. FIG. 3 shows third cycle results. The mat of Example 1 was subjected to the same conditions as used in the RCFT test for the mat of this Comparative Example 1 and is shown as curve 1 in FIG. 3. It can be seen from FIG. 3 that the mat of Comparative Example 1 did not maintain sufficient pressure to hold the monolith in place under the simulated conditions whereas the mat of Example 1 maintained sufficient pressure to hold the monolith.

Comparative Example 2

Comparative Example 2 (C2) comprised a non-woven, binder-free fiber mat made of silica fibers commercially available under the name Silcosoft™ from BGF industries in Altvista, Va. The fibers in the mat have an average diameter of 9 microns.

This material was subjected to the Real Conditions Fixture Test (RCFT) using the simulated temperature conditions of Comparative Example 1 at a mount density of 0.4 and 0.45 g/cm$^3$. Test results for the third cycle are shown in FIG. 3 as curve C2a (0.45 g/cm$^3$ mount density) and C2b (0.40 g/cm$^3$ mount density), and show that the mat of Comparative Example 2 also did not maintain sufficient pressure, to hold the monolith in place under conditions simulating these encountered with a diesel engine. The Y axis in FIG. 3 representing the pressure had a scale of 0 to 600 kPa.

Comparative Example 3

Comparative Example 3 (C3) comprised a commercially available intumescent pollution control device mounting mat. It comprises about 55% unexpanded vermiculite, about 37% fiber, and about 8% organic binder. The fibers are melt-formed, amorphous, shot-containing alumina/silica fibers having a diameter of about 2-3 microns having a length of not more than 0.5 inch.

Comparative Example 3 was tested according to the Hot Vibration Test at 300° C. The sample failed after 8 hours. Hot Vibration Test results are summarized in Table 2 Comparative Example 3 was also tested in the Cyclical Compression Test. Results are shown in Table 3 and show that at diesel pollution control device temperatures (i.e., average mat temperature of 250° C.), the mat keeps only 25.3% of its original pressure after 1000 cycles which is unacceptably low.

Comparative Example 3 was also tested in the RCFT test using the temperature conditions of Example 1. An unacceptably low holding force already after the first cycle was noted.

Comparative Example 4

Comparative Example 4 (C4) comprised a reduced vermiculite intumescent pollution control device mounting mat that is commercially available. It comprised about 37% unexpanded vermiculite, about 54% fiber, and about 9% organic binder. The fibers were the same as those of Comparative Example 3.

Comparative Example 4 was tested according to the Hot Vibration Test at both 300° C. and 500° C. The sample failed after 8 hours at 300° C. and failed after 18 hours at 500° C. Hot Vibration Test results are summarized in Table 2.

Comparative Example 5

Comparative Example 5 (C5) comprised a wet laid mat prepared from melt-formed, amorphous, shot containing alumina silicate fibers available as Kaowool Bulk Fibers from Thermal Ceramics in Augusta, Ga. The fibers have a diameter of 2-3 microns and a length of about 0.5 inch.

Comparative Example 5 was tested according to the Cyclical Compression Test described above under Test Methods and exhibited a percent retention of 49.8% which is unacceptable for use in a pollution control device for diesel engines. Cyclical Compression Test results are summarized in Table 3.

Comparative Example 6

Comparative Example 6 (C6) comprised "a non-woven binder-free mat material" commercially available from Thermal Ceramics UK Lmtd. Wirrel, Merseyside, England as Ultrafelt™ Paper having a density of 12 lb/ft3 (0.2 g/cm$^3$) The mat is a needle bonded mat of alumina/silica fibers (47% $Al_2O_3$ and 53% $SiO_2$). According to the technical data sheet of the manufacturer of the mat, the fibers would have a length that is longer than typically used in paper making. This would indicate the fibers would have a length of more than 0.5 inch.

Comparative Example 6 was also tested according to the Cyclical Compression Test described above under Test Methods and exhibited a percent retention of 41.2%, which is unacceptable low.

Cyclical Compression Test results are summarized in Table 3.

Comparative Example 7

Comparative Example 7 (C7) comprised a commercially available non-intumescent pollution control device mounting mat made of high alumina polycrystalline ceramic fibers. The fibers are essentially shot-free and have an average diameter of 3 microns.

Comparative Example 7 was also tested according to the Cyclical Compression Test described above under Test Methods and exhibited a percent retention of 81.1%. Cyclical Compression Test results are summarized in Table 3. Retention force of these very expensive fibers were acceptable, but not as good as the present invention.

TABLE 1

Summary of compositions of mounting mats according to the invention

| Example | Glass type | Fiber diameter, μm | Fiber length, mm |
|---|---|---|---|
| 1 | S-2 | 9 | 25.4 |
| 2 | E | 10 | 25.4 |
| 3 | R | 10 | 36 |
| 4 | R + E | R = 10 | R = 36 |
| | Two layer | E = 10 | E = 25.4 |
| 5 | S-2 + E | S-2 = 9 | S-2 = 25.4 |
| | Two layer | E = 10 | E = 25.4 |

TABLE 2

Summary of results from the hot vibration test

| Ex. | Mount Density ($g/cm^3$) | Peak Temp. (° C.) | Peak Vibration ($g^2/Hz$) | Total No. Cycles | Results |
|---|---|---|---|---|---|
| 1 | 0.32 | 300 | 0.16 | 23 | No failure after 72 hours |
| 1 | 0.32 | 500 | 0.16 | 25 | No failure after 80 hours |
| C3 | 1.04 | 300 | 0.04 | 2 | Failed after 8 hours |
| C4 | 0.81 | 300 | 0.04 | 2 | Failed after 8 hours |
| C4 | 0.85 | 500 | 0.16 | 4 | Failed after 18 hours |

TABLE 3

Summary of cyclical compression test results

| Example | Mounting mat type | Percent retention after 1000 cycles at 250° C. |
|---|---|---|
| 2 | Single layer E | 86.3% |
| 3 | Single layer R | 95.5% |
| 5 | One layer E, one layer S-2 | 82.2% |
| C3 | intumescent mat | 25.3% |
| C5 | TC HA-Bulk | 49.8% |
| C6 | Ultrafelt ™ | 41.2% |
| C7 | Polycrystalline Mat | 81.1% |

The invention claimed is:

1. A mat for mounting a pollution control element in a casing of a pollution control device, said mat being a non-intumescent mat comprising at least 90% by weight based on the total weight of the mat of chopped magnesium aluminium silicate glass fibers that have a number average diameter of 5 μm or more and a length of 0.5 to 15 cm, said glass fibers being needle punched or stitch bonded, said mat being free or substantially free of organic binder and being comprised of at least two layers of said chopped magnesium aluminium silicate glass fibers, wherein said at least two layers differ in their magnesium aluminum silicate glass fiber composition.

2. Pollution control device comprising a pollution control element arranged in a easing with the mounting mat according to claim 1.

3. Pollution control device according to claim 2 wherein glass fiber compositions differ in the length of glass fiber and/or the average diameter of the glass fiber.

4. Pollution control device according to claim 3 wherein the glass fiber compositions also differ in the chemical composition of the glass fiber.

5. Pollution control device according to claim 4 wherein the glass fibers are selected from the group consisting of E-glass fibers, S-glass fibers, S-2 glass fibers, R-glass fibers and a mixture thereof.

6. Pollution control device according to claim 2 wherein the glass fiber compositions differ in the chemical composition of the glass fiber.

7. Pollution control device according to claim 2 wherein the glass fibers are selected from the group consisting of E-glass fibers, S-glass fibers, S-2 glass fibers, R-glass fibers and a mixture thereof.

8. Pollution control device according to claim 2 wherein one of said at least two layers contacts said casing and comprises E-glass fibers, and another of said at least two layers contacts said pollution control element and comprises at least one of S-glass fibers, S-2 glass fibers, R-glass fibers and a mixture thereof.

9. Pollution control device according to claim 2 wherein the mount density of said non woven mat is between 0.2 and 0.7 $g/cm^3$.

10. Machine comprising a diesel engine and a pollution control device as defined in claim 2.

11. Machine according to claim 10 wherein said machine is a motor vehicle and said diesel engine is a turbo charged direct injection diesel engine.

12. Machine according to claim 10 wherein said machine is a motor vehicle selected from a truck, a bus or a low capacity passenger vehicle.

13. Method of treating exhaust gas from a diesel engine by subjecting the exhaust gas to a pollution control device as defined in claim 2.

14. Mat according to claim 1 wherein said glass fiber compositions differ in the length of glass fiber and/or the average diameter of the glass fiber.

15. Mat according to claim 14 wherein the glass fiber compositions also differ in the chemical composition of the glass fiber.

16. Pollution control device according to claim 2 wherein said glass fibers comprise aluminium oxide in an amount of 10 to 30% by weight, silicon dioxide in an amount of 52 to 70% by weight and magnesium oxide in an amount of 1 to 12% by weight based on the total weight of the glass fiber and wherein the weight percentages of aluminium oxide, silicon dioxide and magnesium oxide are calculated on a theoretical basis as $Al_2O_3$, $SiO_2$ and MgO respectively.

17. Mat according to claim 1 wherein said glass fiber compositions differ in the chemical composition of the glass fibers.

18. Mat according to claim 1 wherein said glass fibers comprise aluminium oxide in an amount of 10 to 30% by weight, silicon dioxide in an amount of 52 to 70% by weight and magnesium oxide in an amount of 1 to 12% by weight based on the total weight of the glass fiber and wherein the weight percentages of aluminium oxide, silicon dioxide and magnesium oxide are calculated on a theoretical basis as $Al_2O_3$, $SiO_2$ and MgO respectively.

19. Mat according to claim 1 wherein the glass fibers are selected from the group consisting of E-glass fibers, S-glass fibers, S-2 glass fibers, R-glass fibers and a mixture thereof.

20. Mat according to claim 19 wherein one of said at least two layers contacts said casing and comprises E-glass fibers, and another of said at least two layers contacts said pollution control element and comprises at least one of S-glass fibers, S-2 glass fibers, R-glass fibers and a mixture thereof.

* * * * *

UNITED STATES PATENT AND TRADEMARK OFFICE

CERTIFICATE OF CORRECTION

PATENT NO. : 7,704,459 B2
APPLICATION NO. : 10/522492
DATED : April 27, 2010
INVENTOR(S) : Richard Paul Merry It is certified that error appears in the above-identified patent and that said Letters Patent is hereby corrected as shown below:

Title page, Item (57) line 7 of the ABSTRACT, delete “aluminum” and insert --aluminium--.

Column 6, line 11 - Delete “MILL.” and insert --MILL--, therefor.

Column 15, line 45 (Approx.) - In Claim 2, delete “easing” and insert --casing--, therefor.

Column 16, line 12 - In Claim 9, after “said” delete “non woven”.

Signed and Sealed this
Twelfth Day of July, 2011

David J. Kappos

David J. Kappos
*Director of the United States Patent and Trademark Office*